US005152068A

United States Patent [19]

Meister et al.

[11] Patent Number: 5,152,068

[45] Date of Patent: Oct. 6, 1992

[54] AIMING DEVICE FOR ARCHERY

[76] Inventors: Lanny M. Meister; Maurine A. Meister, both of P. O. Box 2943, Redwood City, Calif. 94064

[21] Appl. No.: 753,956

[22] Filed: Sep. 3, 1991

[51] Int. Cl.[5] ..... F41G 1/32

[52] U.S. Cl. ..... 33/265; 124/87

[58] Field of Search ..... 33/265; 124/87, 24.1

[56] References Cited

U.S. PATENT DOCUMENTS

| | | | |
|---|---|---|---|
| 3,867,920 | 2/1975 | Westphal . | |
| 4,179,613 | 12/1979 | Koren | 33/265 X |
| 4,220,983 | 9/1980 | Schroeder | 33/265 X |
| 4,638,565 | 1/1987 | Podany et al. | 33/265 |

*Primary Examiner*—Harry N. Haroian
*Attorney, Agent, or Firm*—James E. Eakin

[57] ABSTRACT

An archery aiming device includes in combination an illuminated bowsight connected to a battery operated electronic module, an automatic mode rotary switch mechanism, and a optional selectable manual mode trigger switch mechanism. The electronic module and bowsight attach to a conventional tournament sight, the rotary switch mechanism attaches to a conventional bowsight, and the optional trigger switch mechanism attaches to a convention trigger device. The bow carries a negative charge from the battery. Selection of either the automatic or the manual mode serves to complete the electrical circuit to operate the illuminated bowsight. The automatic mode additionally tells the archer that he/she has reached precise full draw anchor position prior to shooting the arrow. A draw length calibrator is provided for setting drawing length.

20 Claims, 8 Drawing Sheets

AIMING DEVICE FOR ARCHERY

TECHNICAL FIELD

The present invention relates to a aiming device field archery. Specifically, the aiming device includes an illuminated bowsight which functions as both a target aiming mechanism and as an indicator of precise full draw anchor position.

BACKGROUND OF THE INVENTION

Bowsights are known in field archery for correcting aim both horizontally and vertically Such devices may be mounted on the face or the back of the bow, and typically include an aiming spot within a circular frame. A hood may be provided as a light shield, and the sight may further include a level for vertical alignment purposes. Bowsights may be illuminated and are typically mounted on an adjustable bracket attached to the bow.

One such prior art illuminated bowsight is described in Schroeder U.S. Pat. No. 4,220,983 . The Schroeder bow sight includes a centrally located, battery powered, light-emitting diode. A switch selectively connects and disconnects the battery. While the Schroeder bowsight may aid the archer's aim at a target, the bowsights do not address the archer's precise full draw anchor position.

The correct form for an archer includes proper leg, head, back and arm position in addition to precise full draw anchor position. Practice is required to achieve the proper form and concentration is necessary to maintain consistent form. Precise full draw anchor position includes coordination of several factors, including nocking point, draw length, and anchor point.

The nocking point is the specific location on the bowstring where the back end of the arrow should be placed. The nocking point is typically determined by gradual adjustments with the aid of a commercial bow square designed to select a location slightly above 90 degrees on a horizontal plane from the arrow rest. The selected nocking point is marked and a mocking point locator(s) is attached to the bowstring.

Draw length is measured at full draw from the hex bolt at the center of the riser section of the bow to a selected point at the back end of the emplaced arrow. The anchor point is a specific point on the archer's face or jaw with which the index finger of the drawing hand makes contact at full draw. Draw length is reached at full draw when the index finger touches the pre-determined anchor point. The anchor point is typically either the intersection of the index finger and the corner of the mouth with the thumb under the jaw, or the contact point between the string fingers and chin and edge of jawbone.

As can be seen by the above discussion of the prior art, an unsolved need exists for a device for aiming at the target and for assisting the archer in achieving the precise full draw anchor position prior to shooting.

SUMMARY OF THE INVENTION WITH OBJECTS

A general object of the invention is to provide an aiming device for archery that overcomes the limitations and drawbacks of the prior art to increase the shooting ability of the archer.

A specific object of the invention is to provide an aiming device for archery for aiming at a target and for determining precise full draw anchor position.

Another specific object of the present invention is to provide an aiming device for archery having a manual or an automatic mode to illuminate a bowsight for aiming at a target and for determining precise full draw anchor position.

Still another specific object of the present invention is to provide an aiming device for archery including a bowsight that will illuminate in an automatic mode only when the archer is in the precise full draw anchor position.

Yet another object of the present invention is to provide an aiming device for archery including a bowsight that remains illuminated in a manual mode until the archer releases the arrow from the bow.

One more specific object of the present invention is to provide an aiming device for a compound bow for field archery including a nocking point calibrator.

Yet one more specific object of the present invention is to provide an aiming device for archery including an illuminated bowsight operated by an electrical circuit with an internal ground mechanism thereby using minimal wiring to provide both a manual and an automatic operating mode.

An additional specific object of the present invention is to provide an aiming device for archery with a universal mounting mechanism for attachment to the majority of commercially available tournament sight brackets.

Another additional specific object of the present invention is to provide a relatively inexpensive, easily manufactured and rugged aiming device for archery that may be easily installed on and removed from the bow.

In accordance with the present invention an archery aiming device includes in combination an illuminated bowsight connected to an electronic module, an automatic mode rotary switch mechanism, and a optional selectable manual mode trigger switch mechanism.

A cable connector extends from the bowsight to plug into the electronic module, and both devices include mounting mechanisms for attachment to a conventional tournament sight bracket mounted on a compound bow. The bowsight includes a lens with a aiming dot, an LED for illuminating the aiming dot, and a double-ended hood for shielding the sight.

The electronic module is an A.S.B. plastic case attached to a mounting plate mechanism for connection to the tournament sight bracket. A common ground screw extending through the case enables the bow to carry a negative charge for completing a circuit for the aiming device. A battery, an on/off switch, a power indicator light, a potentiometer, an insulator board, and at least three jack connector inputs are included within the A.B.S. plastic case. Because the bow carries a negative charge from the battery of the electronic module, the illuminated sight will not operate until either the manual mechanism or the automatic mode mechanism is connected to a jack input of the electronic module to close the circuit.

The metal manual trigger switch mechanism mounts to the metal arrow rest device of the bow and includes a cable and jack connector for plug-in attachment to the electronic module to illuminate the bowsight when the circuit is closed. The trigger switch mechanism defines a metal spring in contact with a knock-down metal arrow rest prior to release of the arrow. Release of the string imparts energy to the arrow causing resonance sufficient to trip the knock-down arrow rest thereby breaking the contact with the spring to open the circuit and turn off the illuminated bowsight.

The automatic mode rotary switch mechanism is attached to a conventional bow slide. A metallic adjustor nut is selectively positioned near the end of the slide and carries the negative charge of the bow. A sheave mechanism is mounted on the slide for rotation by the engaged bowstring of the compound bow, and includes a first sheave, a second sheave, and a metal sheave contact. A cable with a jack extends from the sheave bracket for plug-in attachment to the positive pole of the electronic module. The sheave mechanism is insulated from the negatively charged bow. When the full draw anchor position is reached, the metal sheave contact touches the negatively charged adjustor nut to complete the electrical circuit thereby turning on the illuminated sight to assist the archer's aim, and to signal that the archer is in the precise full draw anchor position.

Although the automatic mode is preferred, mode selection is optional after the jack from the bowsight is plugged into the electronic module. To select manual operation, the archer connects the plug-in jack from the trigger switch mechanism to the electronic module and turns the on/off switch to complete the circuit and illuminate the bowsight. A knob from the potentiometer may be turned to adjust the amount of illumination. The archer then places the arrow in the arrow rest, assumes the full draw anchor position, and aims assisted by the illuminated bowsight. When the arrow is released, sufficient resonant force is created to cause the arrow rest to trip thereby breaking contact with the spring, and thereby breaking the electrical circuit so that the LED in the bowsight is turned off.

The jack from the trigger switch mechanism is removed from the electronic module for automatic operation, and the jack from the rotary switch is connected to the electronic module. The electrical circuit will not be completed until the archer has reached the precise full draw anchor position wherein the sheave contact touches the negatively charged adjustor nut. Release of the string causes the sheave mechanism to loose contact with the adjustment nut to open the electrical circuit and turn off the LED light at the bowsight.

The aiming device of the present invention further includes a draw length calibrator and a tester jack having an LED light for testing the electrical circuits of the aiming device. The draw length calibrator enables the archer to quickly determine the draw point and set the position of the adjustor nut accordingly.

In another aspect of the present invention for nonconductive wooden bows, the connector jacks include two wires for grounding purposes.

Other objects, features, aspects and advantages of this invention will be more apparent to those versed in the art from the following description of the drawings and detailed description of preferred embodiments.

DESCRIPTION OF A PREFERRED EMBODIMENT

Figure 1:
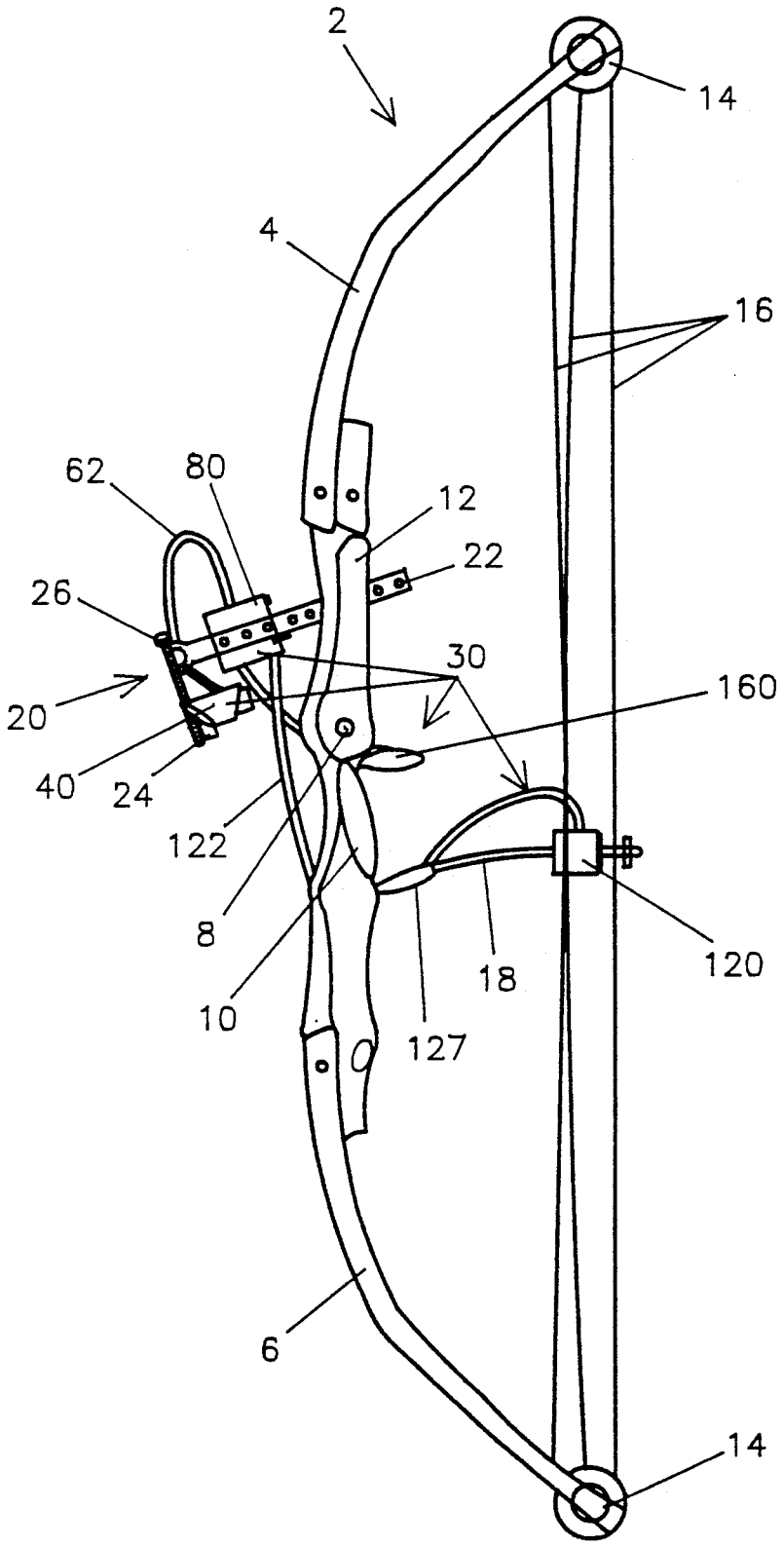
FIG. 1 is an environmental view of a compound archery bow shown with an aiming device of the present invention.

In accordance with the principles of the present invention, the components of an aiming device 30 for archery are shown in use with a compound bow 2 in FIG. 1. The aiming device 30 may be used with all archery bows of the type having a string slide and a permanent or removable tournament sight fixture.

The compound bow 2 includes an upper limb 4, a lower limb 6, an arrow rest and plate region 8, a hand grip 10, and a sight window area 12. The bow 2 is preferably made from metal such as steel, aluminum, manganese, or combinations thereof in order to serve as an internal ground for the aiming device 30. When the bow 2 is operating as the ground for the aiming device 30, the dc current throughout the bow further serves to retard metal corrosion. The compound bow shown in FIG. 1 is a take-down bow, but a unitary bow may also be used.

An eccentric pulley wheel 14 is mounted at the terminus of both the upper limb 4 and the lower limb 6. The bow string 16 is preferably made of a synthetic material such as Dacron (TM).

A cable rod 18 extends from the bow face, and a conventional tournament sight bracket 20 is bolted to the outside of the sight window area 12. The tournament sight bracket 20 typically includes an extensible T-bar 22 slidably mounted through a side mount (not shown) for bolting to the sight window area 12. The tournament sight bracket includes an adjustable vertical sight bar 24 for attachment of a bowsight and an adjustment knob 26 for positioning the bowsight. The conventional tournament sight bracket is typically constructed of a metallic conductive material. When electrically charged, the bolts used to attach the tournament sight bracket to the bow are generally sufficient to transmit a charge to the metal composite bow.

Figure 2:
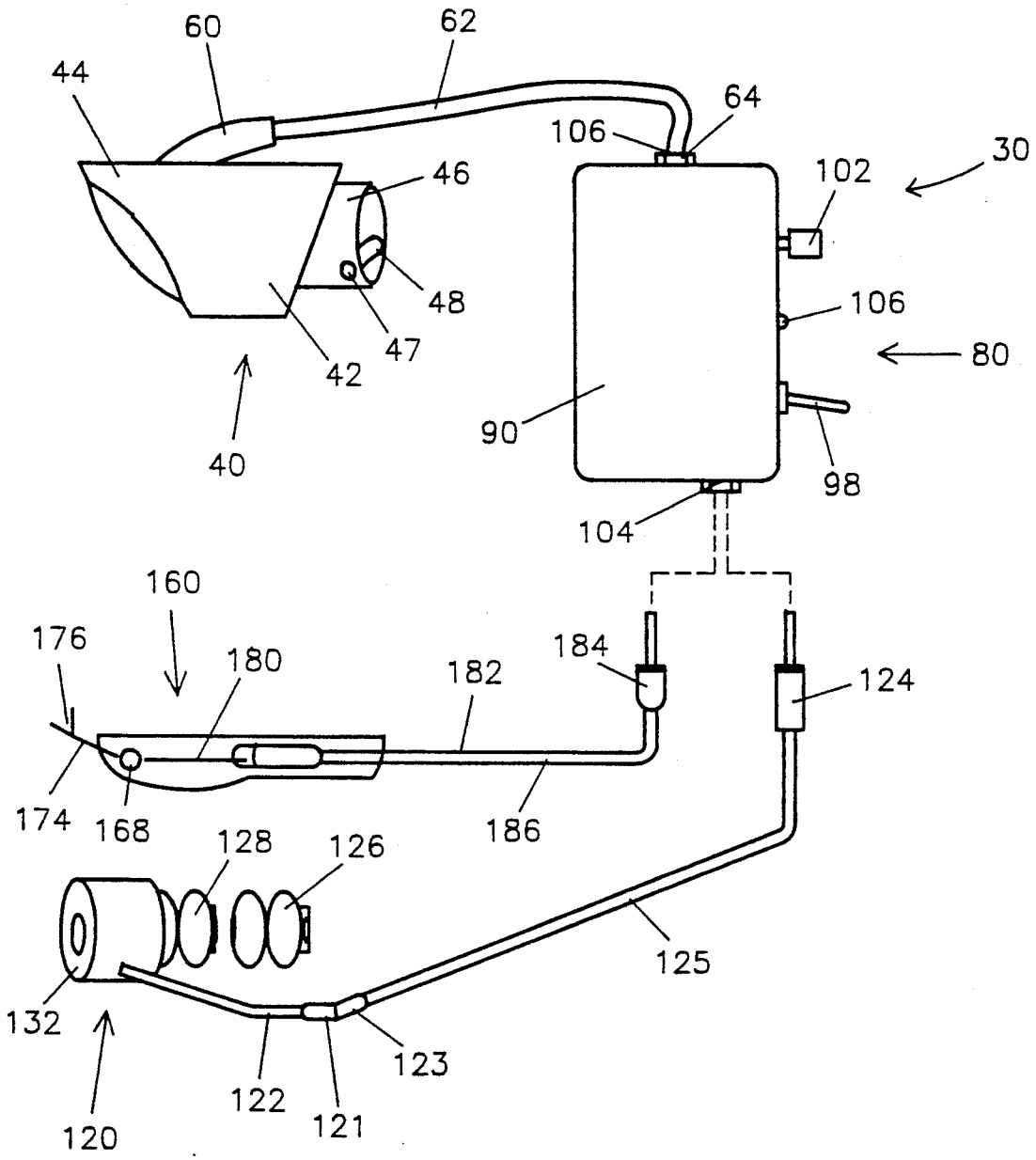
FIG. 2 is a perspective view of the main components of the aiming device of FIG. 1 showing the cable and jack connection mechanisms to the electronic module for the trigger switch mechanism, the rotary switch mechanism, and the illuminated bowsight.
Figure 3A:
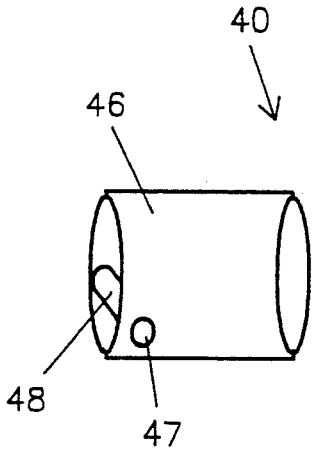
FIGS. 3A, 3B and 3C comprise an exploded perspective view of the components of the illuminated bowsight.
Figure 3B:
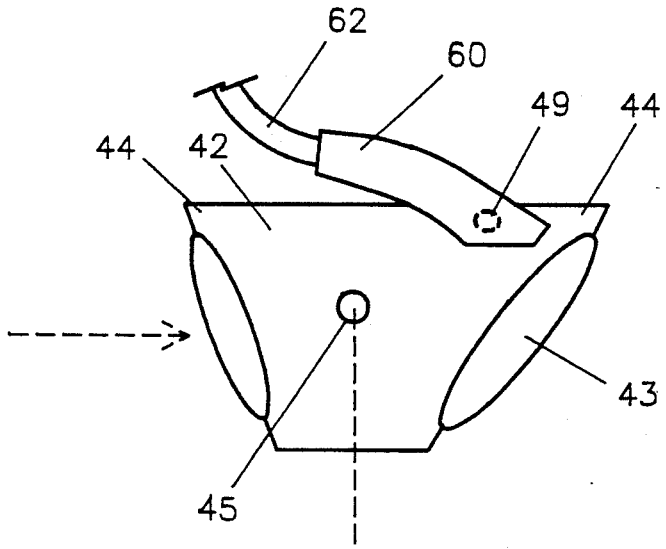
Figure 3C:
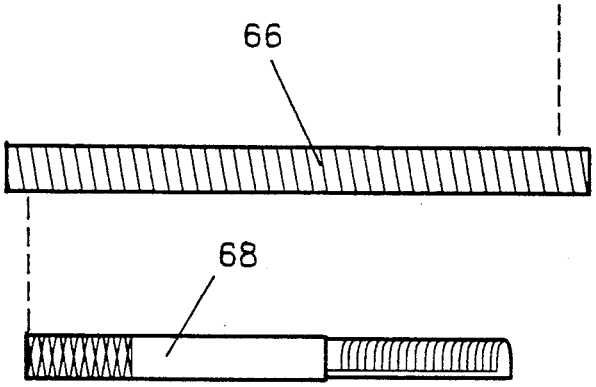
Figure 3D:
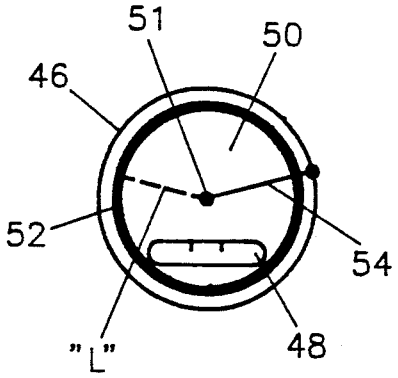
FIG. 3D is an front end view of the illuminated bowsight showing the lens and LED mechanism.
Figure 3E:
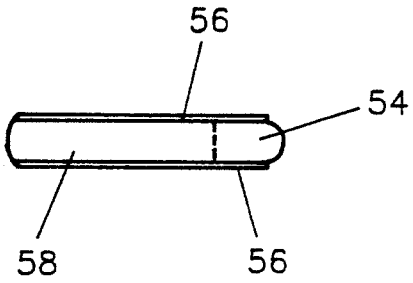
FIG. 3E is a side view of the LED mechanism in partial section showing the supports and insulator.

Referring now to FIGS. 1 and 2, the aiming device 30 of the present invention includes an illuminated bowsight 40, a electronic module 80. a rotary switch mechanism 120 and a manual trigger switch mechanism 160.

The Bowsight 40

Referring now to FIGS. 2 and 3A through 3E, the bowsight 40 includes a generally cylindrical bonnet 42 preferably made from aluminum with anti-shock specifications to reduce cycles per second thereby reducing vibrations. The bonnet 42 defines a glare reducing hood extension 44 at each upper end thereof, and a hollow interior 43. A threaded aperture 45 is provided through the side of the cylindrical bonnet 42 for receiving a rod 66 for mounting the bowsight 40 to the bar 24. It will be recognized by those skilled in the art that the threaded aperture 45 may also be formed in the opposite side of bonnet 42 for left hand mounting. The outside of the aluminum bonnet 42 may be painted if desired, but it is preferred to leave the interior surface unpainted to further reduce glare.

A tubular aluminum bonnet sleeve 46 is preferably epoxied inside of the bonnet 42 as shown in FIG. 2. A conventional level 48 is placed through the sleeve 46 through aligned holes 47 where it is epoxied in place. A level mounting bracket (not shown) may also be provided for the level 48.

A lens 50 is surrounded by a lens retainer 52 which is preferably glued within the sleeve 46. The surface of the lens 50 is preferably treated or coated with an anti-reflection substance to reduce glare during sighting. The preferred lens is generally +0.50 power, however lens power may vary from +0.50 to +100.00 or more if desired. A colored dot 51 is placed typically in the center of the lens 50 which presents a bulls eye image to the archer when the dot 51 is illuminated, although the dot 51 may be placed off-center as desired.

An L.E.D. lamp 54 is installed through in a hole 49 in the bonnet 42 and positioned so that the tip of the lamp 54 is aligned over the colored dot 51. When the dot 51 is placed off-center, the lamp 54 will be positioned above, below or to the side of the dot 51. The lamp 54 may be installed in the position shown in the solid line in FIG. 3D, or alternatively as shown in the dotted line "L" for left hand installations. In either case, the L.E.D. lamp 54 does not extend across the entire lens thereby reducing distortion during focusing. The L.E.D. lamp 54 is protected by L.E.D. supports 56 and insulator 58.

The L.E.D. lamp 54 connects to the insulated cable 62 with a male jack 64 for plug-in connection to the electronic module 80. A bonnet wire cover 60 shields and supports the wire. The cable 62 is of a length sufficient to permit disassembly of the L.E.D. lamp 54 to change the lamp 54 at least once, and to enable the bowsight 40 to be selectively positioned on the bar 24.

A externally threaded stabilizer rod 66 is placed in the threaded opening 45 to attach the bowsight 40 to the bar 24 of the bracket 20. The rod 66 is constructed from stainless steel to decrease vibrations, and an interiorly threaded node silencer element 68 may be threaded over the rod 66 for dampening shock.

The Electronic Module 80

Figures 4A, 4B:
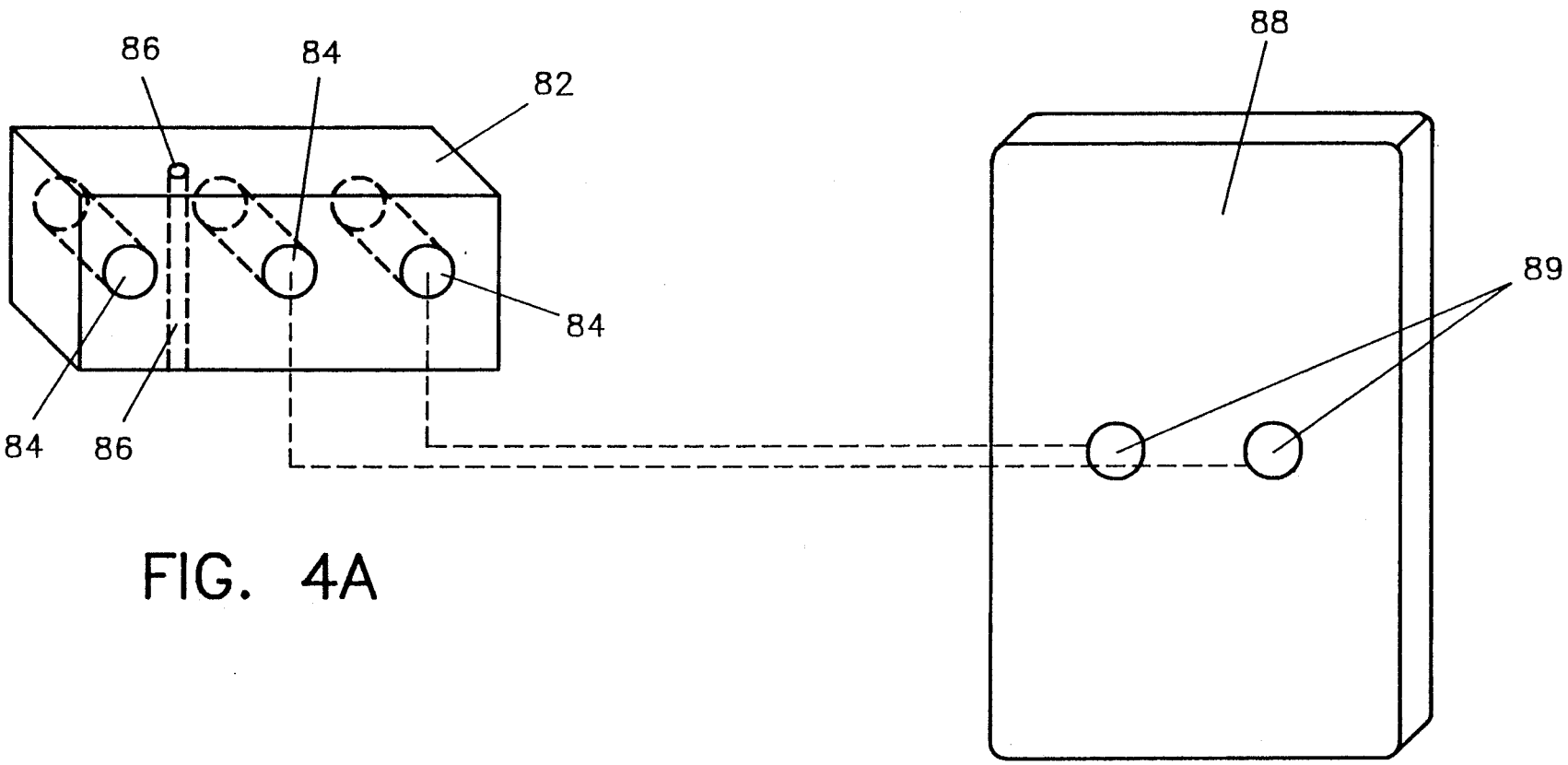
FIGS. 4A and 4B comprise a perspective view of the components of the electronic module mounting mechanism, including a mounting plate and a mounting block further showing an insulator and mounting holes in hidden view.

Referring now to FIGS. 4A, 4B, 5A, and 5B, the components of the electronic module 80 are shown. FIGS. 4A and 4B show the mounting components for attaching the electronic module 80 to the tournament sight bracket 20.

A generally rectangular aluminum mounting block 82 includes at least one, and preferably three, threaded mounting holes 84 through a long side of the block 82. The use of only one or two of the mounting holes 84 for attachment to the bracket 20 with conventional screws and washers (not shown) permits the electronic module 80 to be selectively positioned on the bracket 20. An insulator 86 is placed in an insulator channel 83 formed through the block 82. The insulator 86 holds a male jack connector from the rotary switch mechanism or the trigger switch mechanism when not in use.

An A.S.B. plastic planar mounting plate 88 having mounting holes 89 attaches to the block 80 by screws placed into two of the mounting holes 84 in block 80.

The plate 88 mounts flush against the bottom surface 87 of an A.S.B. plastic electronic module case 90. The case 90 is generally rectangular and includes an interior space 91 for holding the electronic components of the aiming device 30, a cover 92 and a shock pad 94 made from a resilient, shock absorbing material such as foam rubber. The shock pad 94 and cover 92 are attached by screws 85 to four attachment housings 83 in the four corners of the case 90.

Figure 5A:
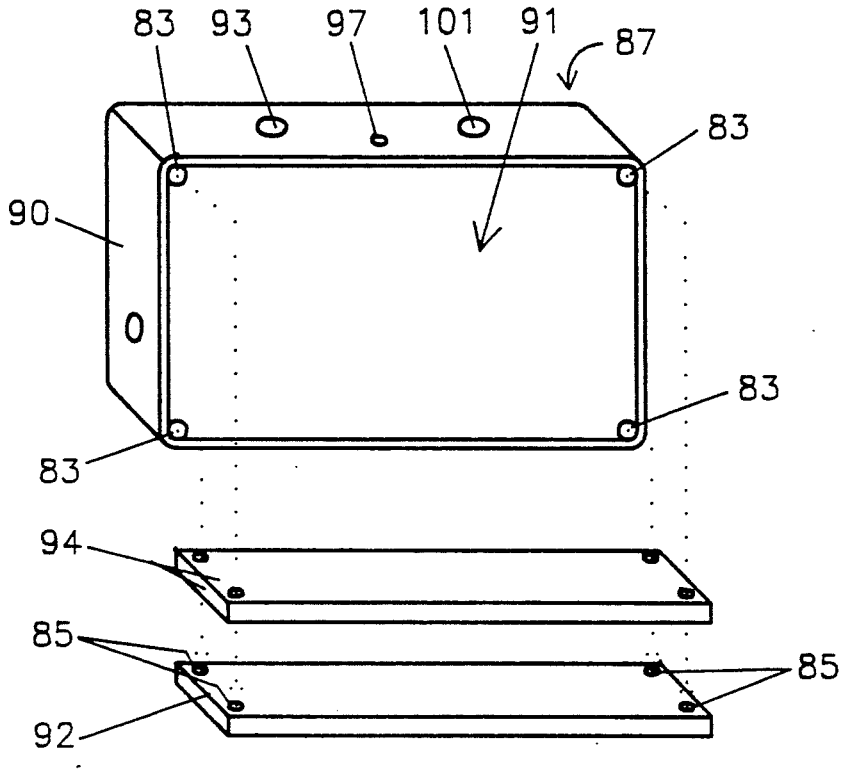
FIG. 5A is an exploded perspective view of the electronic module case, cover and shock pad.
Figure 5B:
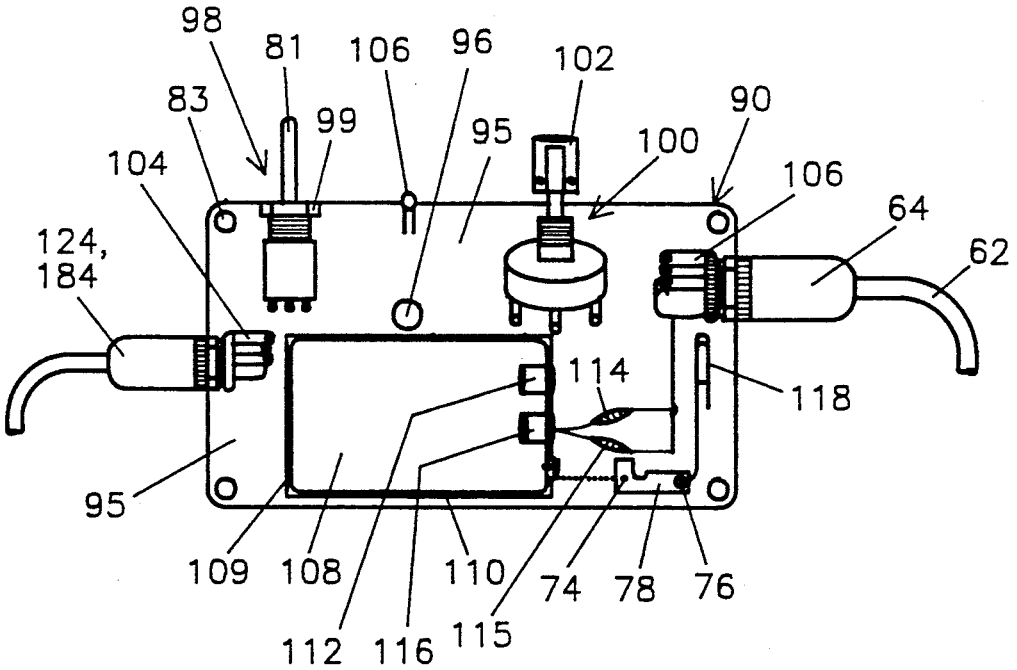
FIG. 5B is a top plan view of the electronic module case showing the internal components.

Referring specifically to FIG. 5B, the bottom surface 95 of the case 90 includes a common ground screw 96 that carries the negative charge from the battery pole 112 through the contiguous plate 88, through the block 80, through the bracket 20 and hence to the bow 2. The bow 2 serves as an internal negative terminal for the circuit of the aiming device 30.

The electronic components include a conventional manual switch 98, preferably a double throw single pole switch, installed through a switch hole 93 and secured to the case 90 with a washer and nut assembly 99. The switch 98 is operated with a manual toggle 81 having an "off" and an "on" position.

A conventional potentiometer assembly 100 having a variable resistor is installed through a potentiometer hole 101 in the case 90 and secured thereto with a nut and washer assembly (not shown). A knob 102 permits the user to vary the output of the L.E.D. lamp 54 in the bowsight 40 from 100 percent capacity to approximately 10 percent capacity.

An L.E.D. indicator lamp 106 is mounted through L.E.D. hole 97 in case 90. The lamp 106 is preferably a 2 volt L.E.D. designed to signal the user when the toggle 81 is switched to the "on" position.

A female jack input connector 106 is provided for the male jack 64 from the bowsight L.E.D., and a female jack input connector 104 is provided for the jacks from either the trigger switch mechanism 160 or the rotary switch mechanism 120, as selected by the archer.

Power for the circuits is supplied from preferably a 9 volt battery 108. The battery 108 is installed in an aluminum battery chassis 109. The battery chassis 109 defines lateral sides 110 for securing the battery 108 in place. Two wires from the positive battery pole 116 include current limiting resistors 114, 115 respectively. An insulator board 18 includes an insulator rivet 76 for a heat sink 118, and an insulator rivet 74 to the battery chassis 109.

Figure 6:
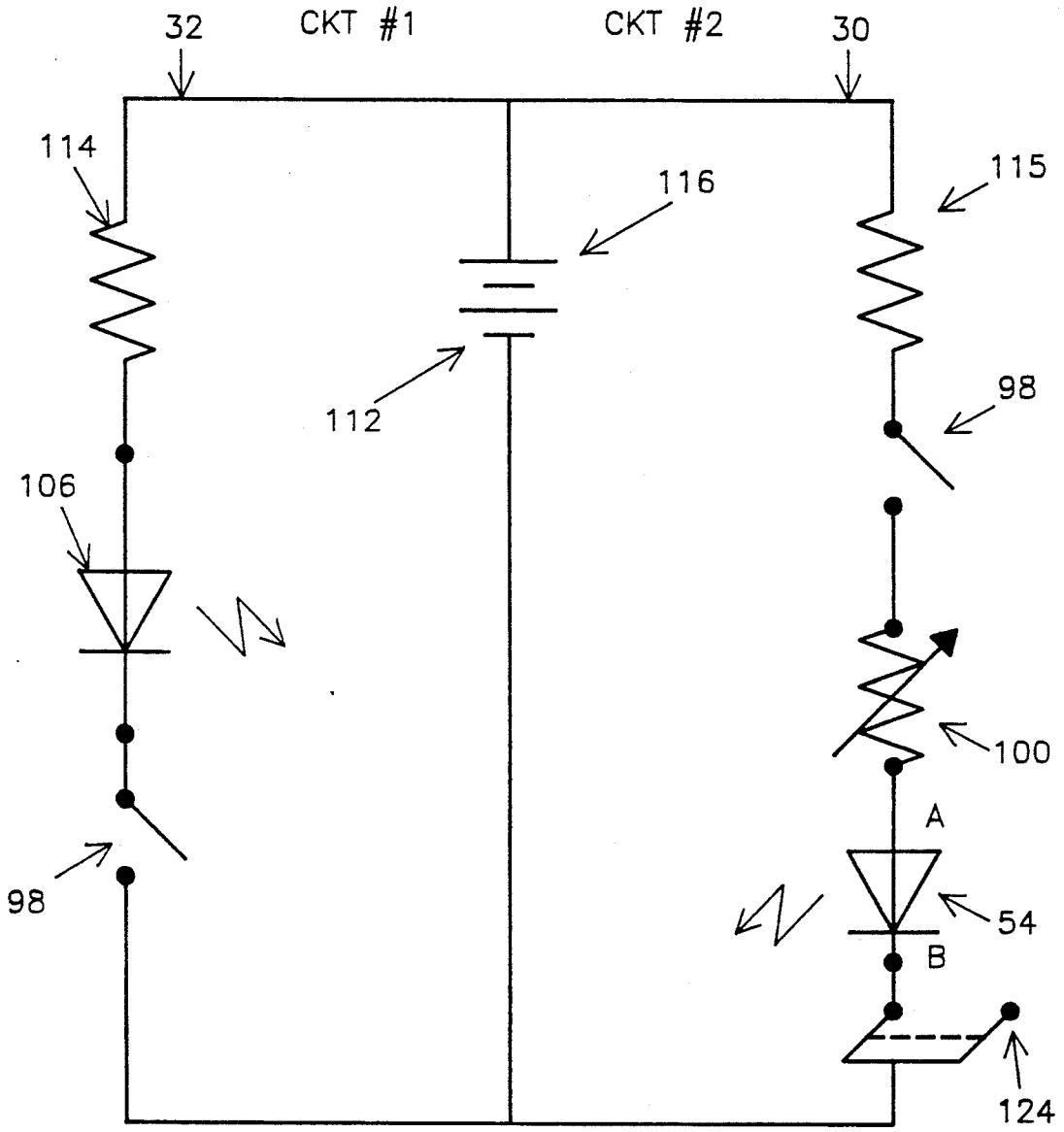
FIG. 6 is the diagram of the electrical circuits of the present invention.

The series/parallel electric circuits that operate the aiming device 30 are shown in FIG. 6. Two teflon coated wires 32, 33 with current limiting resistors 114, 115 respectively, extend from the positive battery pole 116 to create two separate circuits. The first circuit, wire 32, operates the L.E.D. lamp 54 in conjunction with the manual trigger switch 160 or the automatic rotary switch 120. The second circuit, wire 33, parallels the first circuit and operates the indicator L.E.D. 106 to show that the power source has been turned on. The current limiting resistors 114, 115 each provide approximately a 2 volt output to the first and second circuits, respectively, from the 9 volt battery 108.

Referring now to the first circuit, wire 32 includes the current limiting resistor 114 and extends from the positive battery terminal 116 to the L.E.D. lamp 106 which is wired to the on/off switch 98. Closing of the switch 98, which is wired to the negative battery terminal 112, completes the first circuit thereby causing the indicator lamp 106 to light.

Referring now to the parallel second circuit, wire 30 includes the current limiting resistor 115 and extends from the positive battery terminal 116 to the on/off switch 98. When the switch is in the on position as described in circuit 1, the second circuit then extends to the potentiometer 100 for varying the output of the L.E.D. 54. It will be recognized by those skilled in the art that the L.E.D. lamp 54 is at a remote location from the electronic module 80 and that the jack connector 106 from the L.E.D. lamp 54 may be connected to the circuit at several locations such as those designated "A" and "B". The second circuit extends next to either the manual switch input from the jack connector 184 or the automatic switch input from the jack connector 124. Both jack connectors 184, 124 carry the negative charge from the bow 2. Connection of either input switch completes the second circuit to the negative battery terminal 112.

It will be recognized by those skilled in the art that a single wire is required for the cables from the trigger switch mechanism 160 and the rotary switch mechanism 120 as long as the bow 2 carries a negative charge to complete the circuit. Double wire connectors may be used when the bow is constructed entirely from wood.

Teflon wires are used between elements inside of the case 90 for insulative purposes.

The Manual Trigger Switch Mechanism 160

Figure 7:
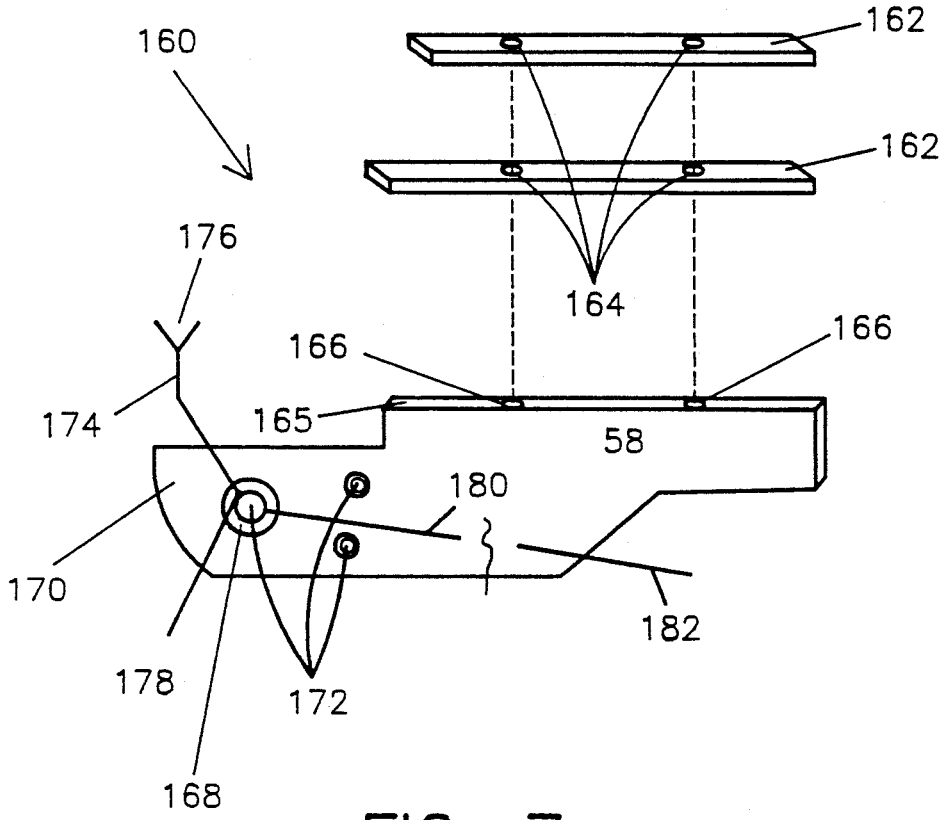
FIG. 7 comprises an exploded perspective side view of the components of the trigger switch mechanism.

Referring now to FIGS. 2 and 7, the trigger switch mechanism 160 is shown. The trigger switch mechanism 160 is used with a conventional archery arrow rest, such as a ST -Series Inertia Rests manufactured by Barner/Timeless, that attaches to the bow 2. Such devices generally include an adjustable V-shaped, knock-down arrow rest. The trigger switch mechanism 160 is mounted to the arrow rest device by at least one shim 162. Several shims may be necessary to correctly position the switch mechanism 160. The shims 162 include mounting holes 164 therethrough for attachment to a shelf 165 that includes mating holes 166. The holes 164 and 166 are also used to fasten the trigger switch mechanism 160 to the arrow rest (not shown).

An anchor housing 168 is fastened to and positioned on a lateral shelf 170 at one or more apertures 172. A conventional spring lock set screw (not shown) is preferred to fasten the housing 168 to the lateral shelf 170.

A metal spring 174 with a V-shaped notch 176 is mounted through the side of the housing 168 and positioned so that the notch 176 engages the knock-down arrow rest (not shown). The opposite end 178 of the spring 174 is encased in an insulating cover and connected to a wire 180 leading from the housing 168 to an insulated wire 182 with a male jack 184 for connection to the female input connector 104 in the electronic module 80. A negative ground wire 186 from wire 182 extends to the trigger switch mechanism 160.

To operate the trigger switch mechanism 160, the archer plugs the male jack 184 on wire 182 into connector 104 and turns on switch 98 to activate L.E.D. indicator light 106 and L.E.D. bowsight lamp 54. When the archer releases the string 16, energy is imparted to the arrow sufficient to cause resonance at the arrow rest to trip the knock-down rest thereby breaking the contact with the spring 174. The electrical circuit is broken thereby turning off the lamp 54 at the bowsight 40. When the arrow rest is again positioned for shooting an arrow, contact is reestablished with the spring 174 so that lamp 54 is again lit.

Automatic Mode Rotary Switch Mechanism 120

Figure 8:
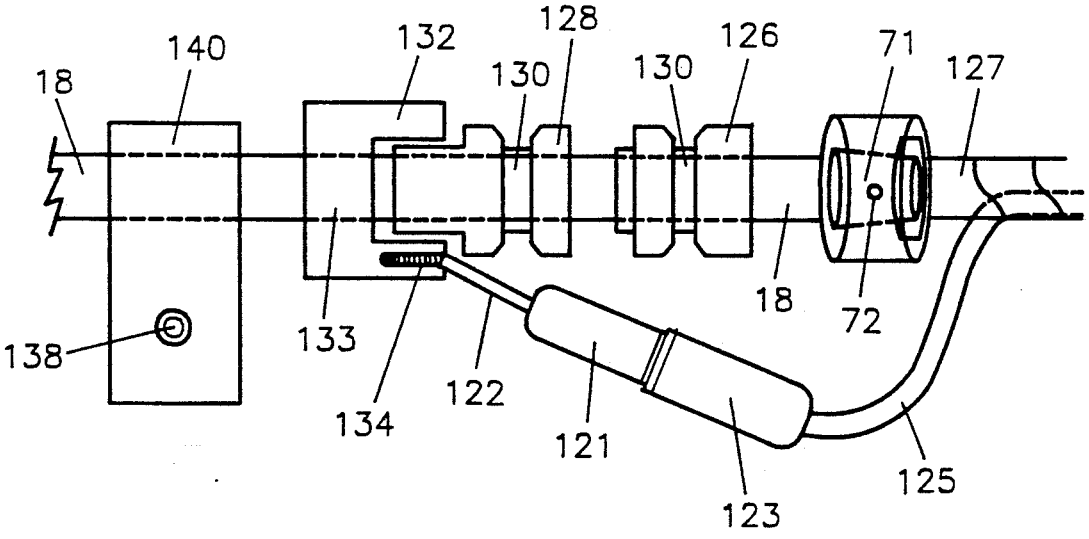
FIG. 8 is an exploded side view in partial section of the rotary switch mechanism, including the adjustor nut, sheaves and cable connectors.

Referring now to FIGS. 1, 2, and 8, the rotary switch mechanism 120 is shown. The rotary switch mechanism 120 is mounted on the bowslide 18. A cable 122 with a female jack 121 extends from the rotary switch 120 to connect to a male jack 123 on a cable 125 having a second male jack 124 at its opposite end which connects to the female input connector 104 of the electronic module 80. Cable 125 is secured to the bowslide 18 by a slide wrap 127 secured at each end with a suitable fastener, such as a bezel 71 and set screw 72. The cable 25 serves only as a positive lead.

The rotary switch 120 includes a first sheave 126 and a second sheave 128. The sheaves 126, 128 are of molded plastic construction and may be made from any suitable nonconductive material. Channels 130 are provided in the sheaves 126, 128 for placement and control of the string 16 of the compound bow 2. A metal sheave contact 132 defines a passageway 133 therethrough and includes a cable port 134 for the cable 122. Sheave 128 defines a shank 136 for engagement through the passageway 133 of the sheave contact 132. The engagement of the shank 136 within the passageway 133 prevents the metal sheave contact 132 from contacting the metal bowslide 18 to receive the internal negative charge from the bow 2.

A metal adjustor nut 140 is slidably fastened to the bowslide 18 and positioned to indicate full draw length in a manner yet to be described. The adjustor nut 140 carries the internal negative charge of the bow 2. A bolt passes through a hole 138 to secure the position of the nut 140.

To operate the aiming device 10 using the automatic mode, the archer places the jack 124 in the jack connector 104 and turns on the switch 98. Because the sheave is not in contact with the negatively charged bow 2, the circuit is open and the bowsight lamp 54 does not turn on. The archer then prepares to shoot an arrow by drawing the string 116. Drawing the string bends the bow 2 which causes the sheaves 128, 130 to rotate in opposite directions and to slide horizontally over the bowslide 18 towards the adjustor nut 140. When the pre-set precise full draw anchor point is reached, the sheave contact 132 touches the adjustor nut 140 thereby completing the electrical circuit and turning on lamp 54. When the archer releases the string, contact is broken between the sheave contact 132 and the adjustor nut 140 thereby opening the electrical circuit so that lamp 54 turns off.

The automatic mode extends the lifetime of the battery since the circuit is typically only closed for seconds prior to shooting the arrow.

The rotary switch mechanism 120 provides additional information to the archer regarding the condition of the bow 2. Once the archer has determined the correct anchor position and used the aiming device 30, any shift in the performance of the mechanism is a signal that the bow is not functioning properly. For instance, if the L.E.D. lamp 54 were to activate prior to reaching the precise anchor position, the bow string may be too cold. Conversely, when the L.E.D. lamp fails to light, the string may be improperly stretched or it may be too hot.

The Adjustor Gauge 200

Figure 9:
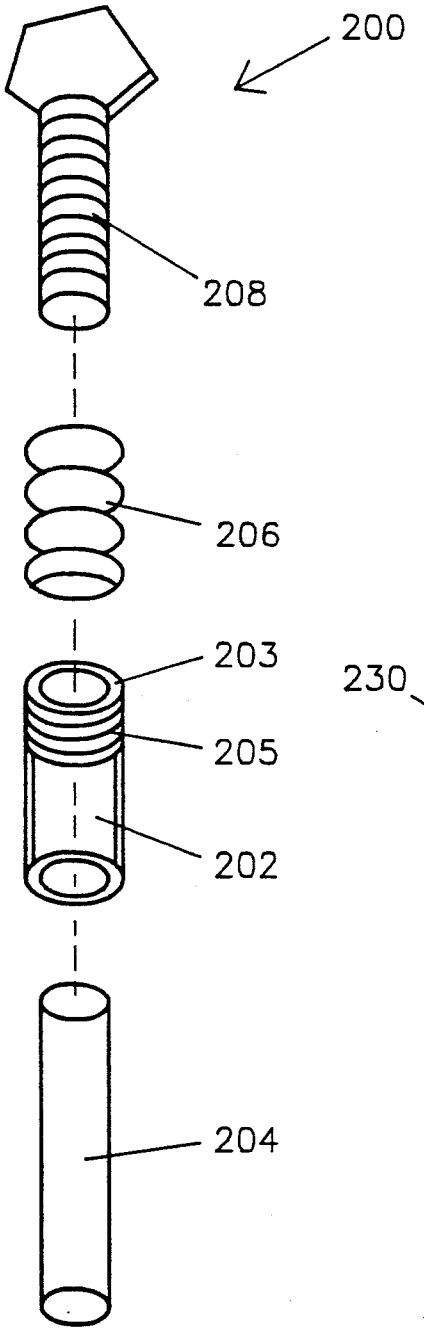
FIG. 9 shows an exploded perspective view of the adjustor gauge.

Referring now to FIG. 9, an adjustor gauge 200 is shown. The gauge 200 includes a hollow sleeve 202 for engagement of a calibrator dowel 204. One end 203 of the sleeve defines internal threads 205.

The dowel 204 is preferably made from a soft material such as wood so the archer may easily make a pencil line or the like to mark his/her draw length. A spring 206 is placed within the sleeve 202 to engage the dowel 204. A threaded gauge screw 208 may be gradually turned which compresses, or decompress the spring, until the correct draw length is achieved. The archer then marks the dowel 204. The length marked on the dowel 204 determines the position of the adjustor nut 140 on the bowslide 18.

The correct draw length is determined by installing the adjustor gauge sleeve 202 on the end of the bowslide 18 and rotating the screw 208 in or out until the sheave contact 132 touches the nut 140 at full anchor draw position to light L.E.D. 54. The lamp 54 will not turn on when the nut 140 is too close to the end of the bowslide 18, and full draw will not occur when the nut 140 is too close to the bow 2 because the string 116 will lock up. When the precise position where the lamp 54 just comes on is determined, the archer tightens the nut 140 and rechecks the position. The sleeve 202 is next removed from the bowslide 18, and the wooden dowel 204 is placed in the sleeve 202 flush against the end of the positioned spring 206. The archer then places a pencil or other suitable marking device on the dowel where it meets the sleeve 202 and rotates the dowel 204 to mark it for future settings.

The Test Light and Test Adaptor 220

Figure 10:
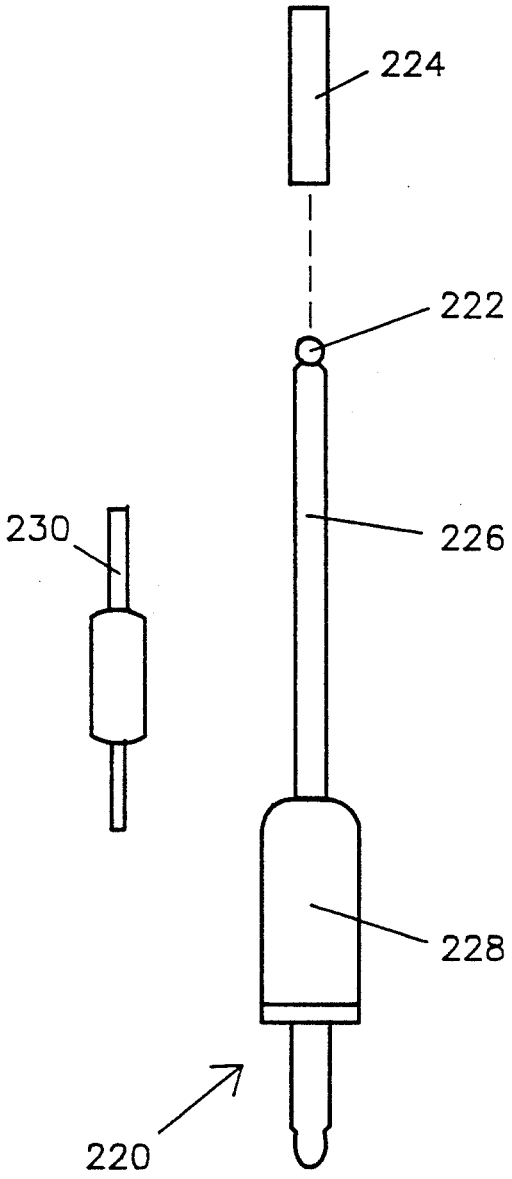
FIG. 10 shows the tester jack and adapter.

Referring now to FIG. 10, the test light and adaptor 220 is shown. The test light includes a 2 volt L.E.D. 222, a protective cover 224, a cable, a jack connector 228, and an adaptor 230. The jack 228 may be plugged into any suitable female connector of a component of the system to ensure that the component is functional and that there has not been a drop in voltage.

To those skilled in the art to which the present invention pertains, many widely varying embodiments and implementations of the principles of the present invention will be suggested from the foregoing. The description and the disclosures presented herein are by way of illustration only and should not be considered to limit the present invention, the scope of which is more particularly set forth in the following claims.

What is claimed is:

1. An aiming device for attachment to a sight bracket of an archery bow having a bowstring slide, the aiming device comprising in combination:

an electric circuit means for applying an electrical potential to the bow;

a bowstring means connected to the electric circuit means; and a first switch means activated by movement to a first predetermined position on the bowstring slide and electrically connected between the bow and the bowstring slide for causing the bowsight means to become illuminated when the bow is pulled such that the first switch means reaches the aforesaid first predetermined position.

2. The aiming device of claim 1 further comprising a second switch means attached to an arrow rest mounted to the bow, the second switch means for causing the bowsight means to become illuminated and until release of the bowstring by the user, the user selecting use of either the first switch means or the second switch means.

3. The aiming device of claim 1 wherein the first switch means comprises an electrical connection means to the circuit means and at least one slidable sheave means having at least one channel means for the bowstring, drawing the bowstring causing the sheave means to rotate and to slide on the bowslide until the sheave means touches a selectably positioned negatively charged contact means, contact with the contact means closing the electrical circuit means.

4. The aiming device of claim 3 wherein the electrical connection means of the first switch means further comprises: a conductive member connected to the circuit, a first of two sheaves made from a non-conductive material and connected to the conductive member, the conductive member contacting the negatively charged contact means to close the electric circuit means.

5. The aiming device of claim 3 further comprising calibration means for determining full draw anchor point position, said anchor point-position for placement of the negatively charged contact means on the bowslide.

6. The aiming device of claim 3 wherein the negatively charged contact means is a nut and bolt assembly attached to the negatively charged bowstring slide.

7. The aiming device of claim 2 wherein the electric circuit means comprises a battery, a first circuit from the battery for turning on a power switch means, a second parallel circuit from the battery for connecting the first or second switch means to operate the illumination means, and means for adjusting the intensity of the illumination means.

8. The aiming device of claim wherein the bowsight comprises:

a lens means having an aiming mark;

a hood means having an interior space for mounting and shielding the lens means;

an illumination means attached to the hood means for illuminating the aiming mark;

a shock absorption means attached to the hood means; and electrical connection means from the illumination means for connecting the bowsight to the electrical circuit means.

9. The aiming device of claim 8 wherein the shock absorption means is an absorption node means connected to a stabilizer rod.

10. An aiming device for attachment to a an archery bow having a bowstring slide and a knock-down arrow rest, the aiming device comprising:

an electric circuit means for applying an electrical potential to the bow;

a bowsight means having connection means to the electric circuit means, the bowsight means defining an illumination means;

a first switch means attached to the bowstring slide for closing the electric circuit means to activate the illumination means, activation of the illumination means assisting aim and indicating full draw anchor point position; and a second switch means attached to the arrow rest for closing the electric circuit means to activate the illumination means and for opening the electric circuit means following release of the bowstring by the user, the use selecting use of either the first switch means or the second switch means.

11. An aiming device for attachment to an archery bow having a bowstring slide and a knock-down arrow rest, the aiming device comprising in combination:

a bowsight having illumination means, an electric circuit system having a first and a second circuit in parallel, the electric circuit system having a battery, an on/off switch means, a means for varying the output of the illumination means, at least two connection means, a first connection means for connecting the illumination means, and a second connection means for selectively connecting either a first switch means or a second switch means, and a means for applying an electrical potential to the bow;

the first switch means for completing the first parallel circuit to activate the illumination means when the bow is drawn to a full draw anchor position; and the second switch means for completing the second parallel circuit to activate the illumination means at least until the user releases the bowstring to shoot the arrow from the bow.

12. The aiming device of claim 11 wherein the power source is a 9 volt battery.

13. The aiming device of claim 11 wherein the illumination means is an L.E.D. lamp.

14. The aiming device of claim 11 wherein the switch is a slidable sheave means connected to the bowslide for contacting a selectively positioned negative charged contact means to close the electric circuit to activate the illumination means, activation of the illumination means assisting aim and indicating full draw anchor point position.

15. The aiming device of claim 11 wherein the second switch is positioned to contact a negatively charged arrow rest connected to the bow, the second switch closing the electric circuit to activate the illuminated bowsight, and opening the electric circuit following release of the bowstring to shoot the arrow and displace the arrow rest.

16. An aim assisting device for attachment to an archery bow comprising:

a signal means for providing status information to a user at a predetermined time when at least one aiming technique is correct;

a switch means for activating the signal means; and an electric circuit having at least two connection means, a first connection means for connecting the signal means, a second connection means for connecting the switch means, and a means for applying an electrical potential to the bow; the switch means for completing the circuit to activate the signal means, the switch means electrically connected between the bow having the electrical potential and the electric circuit at the predetermined time.

17. The aim assisting device of claim 16 wherein the signal means is a bowsight.

18. The aim assisting device of claim 17 wherein the bowsight further comprises illuminating means.

19. The aim assisting device of claim 16 wherein the electric circuit further comprises at least two circuits in parallel.

20. The aim assisting device of claim 19 wherein the switch means comprises a first and second switch, the first switch for closing a first electric circuit to activate the illumination means at the predetermined time, the second switch for closing a second electric circuit to activate the illuminating means until release of an arrow from the bow and for opening the second electric circuit to turn off the illuminating means following release of the arrow from the bow, the user selecting use of either the first switch or the second switch.

* * * * *

UNITED STATES PATENT AND TRADEMARK OFFICE

CERTIFICATE OF CORRECTION

PATENT NO. : 5,152,068

DATED : October 6, 1992

INVENTOR(S) : Lanny M. Meister; Maurine A. Meister

It is certified that error appears in the above-identified patent and that said Letters Patent is hereby corrected as shown below:

Column 1, line 45, change "hex" to "-arrow-."

Column 1, line 46, change "bolt" to "-rest-."

Column 2, line 20, change "point calibrator" to "-set-."

Column 2, line 49, change "A.S.B." to "-A.B.S.-."

Column 5, line 66, change "20" to "-22-."

Column 6, line 3, change "20" to "-22-."

Column 6, line 5, change "20" to "-22-."

Column 6, line 10, change "A.S.B." to "-A.B.S.-."

Column 6, line 14, change "A.S.B." to "-A.B.S.-."

Column 6, line 26, change "20" to "-22-."

Column 6, line 46, change "106" to "-107-."

Column 7, line 21, change "106" to "-107-."

Column 7, line 26, change "negative" to "-positive-."

Column 7, line 27, change "bow" to "-module-."

Column 7, line 67, change "negative ground" to "-positive-."

UNITED STATES PATENT AND TRADEMARK OFFICE

CERTIFICATE OF CORRECTION

PATENT NO. : 5,152,068

DATED : October 6, 1992

INVENTOR(S) : Lanny M. Meister; Maurine A. Meister

It is certified that error appears in the above-identified patent and that said Letters Patent is hereby corrected as shown below:

Column 8, line 24, change "25" to "-125-."

Column 8, line 34, after "136" insert "-136, not shown-."

Column 8, line 37, after "132" insert "-epoxied to 128-."

Column 9, line 21, after "achieved" insert "-with the arrow-."

Column 9, line 25, after "length" insert "-measurement-."

Column 9, line 29, after "position" insert "-with the arrow-."

Column 10, line 7, change "arrow rest" to "-electric potential arrow rest-."

Column 12 line 4, change "negatively" to "-positively-."

Signed and Sealed this

Twelfth Day of October, 1993

*Attest:*

Bruce Lehman

BRUCE LEHMAN

*Attesting Officer*

*Commissioner of Patents and Trademarks*